US005083328A

United States Patent [19]

Toson

[11] Patent Number: 5,083,328

[45] Date of Patent: Jan. 28, 1992

[54] DELIVERY FITTING FOR HYDROMASSAGE BATH TUB

[75] Inventor: Carlo Toson, Percoto, Italy

[73] Assignee: Keoma Srl. Gorizia, Italy

[21] Appl. No.: 518,561

[22] Filed: May 3, 1990

[30] Foreign Application Priority Data

May 3, 1989 [IT] Italy ..... 82537 A/89
Jul. 24, 1989 [IT] Italy ..... 59385/89[U]

[51] Int. Cl.[5] ..... A61H 33/02
[52] U.S. Cl. ..... 4/541; 4/542
[58] Field of Search ..... 4/541, 542, 543, 544; 239/124, 412, 428.5

[56] References Cited

U.S. PATENT DOCUMENTS 3,287,741 11/1966 Nash ..... 4/542 X
4,408,721 10/1983 Cohen et al. ..... 239/428.5 X
4,715,071 12/1987 Henkin et al. ..... 4/542
4,901,926 2/1990 Klotzbach ..... 4/542 X

FOREIGN PATENT DOCUMENTS 1026800 2/1978 Canada ..... 4/542
0168823 1/1986 European Pat. Off. ..... 4/542
3903477 8/1990 Fed. Rep. of Germany ..... 4/542

*Primary Examiner*—Henry J. Recla
*Assistant Examiner*—Robert M. Fetsuga
*Attorney, Agent, or Firm*—McAulay Fisher Nissen Goldberg & Kiel

[57] ABSTRACT

A delivery fitting for hydromassage bath tub has an axial conduit formed by the assembling of three components to eject the water mixed with air into the tub and an opening controlled by a valve for discharging and/or recycling the water sucked from the tub by a pump.

19 Claims, 11 Drawing Sheets

DELIVERY FITTING FOR HYDROMASSAGE BATH TUB

BACKGROUND OF THE INVENTION

This invention relates to delivery fittings for bath tubs suitable to deliver a jet of water mixed with air into the bath tub.

DESCRIPTION OF PRIOR ART

Delivery fittings for bath tubs, in particular the so called whirlpool tubs, are known. Generally speaking, they have an inlet conduit or duct having a Venturi cross-section at which a depression occurs when the water is passing through, and some air is sucked in such air and water being mixed and ejected from the delivery fitting to act as a massage on the user's body laid down in the bath tub.

Usually the bath tubs have one outlet on the bottom of the tub to drain the water, an overflow connected with the outlet and a suction fitting or device in the outlet for recycling the water through a pump.

An object of this invention is a delivery fitting for a bath tub suitable to deliver a jet of water mixed with air and further to drain the water from or recycle the water in the bath tub.

Another object of this invention is a delivery fitting having a simple and stout structure easy to be manufactured.

The subject of this invention is a delivery fitting for a hydromassage bath tub comprising an inlet body (12) fixed to the tub wall and connected with a first duct (13) feeding water under pressure and a second duct (14) sucking air, an axial delivery conduit (29) to deliver water mixed with air, having a cross-section at each end (30, 39) larger than that at an intermediate portion (31) to have a Venture effect, said second duct end having a nozzle (2) axially aligned with said delivery conduit (29), the end of said nozzle being at a fixed distance from said intermediate portion (31), characterized in that said inlet body (12) has an aperture (26) to discharge the water, the aperture being positioned on the wall of the delivery fitting and controlled by a valve (50), said aperture being connected to a pump for the water suction.

BRIEF DESCRIPTION OF THE DRAWINGS

Other aspects and advantages of this invention will be more apparent from the description based on the following drawings in which.

DESCRIPTION OF THE PREFERRED EMBODIMENTS

Figure 1:
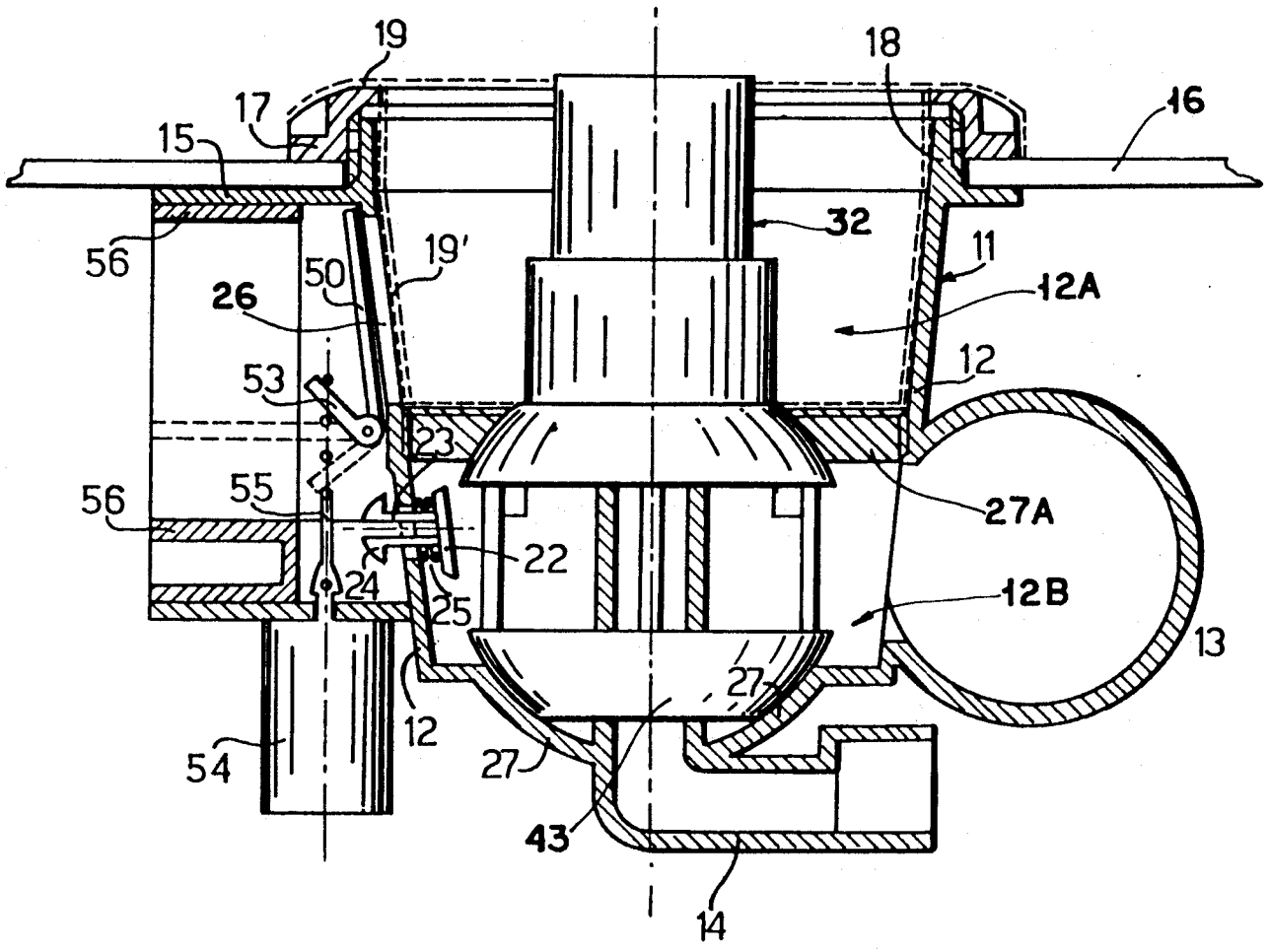
FIG. 1 is a lateral view, partially in cross-section, of the delivery fitting, according to the present invention.

With reference to FIG. 1, the delivery fitting for bath tub has a one-piece main body 11, which defines:

(i) the inlet body 12 having a shape of a truncated cone and divided into an external portion 12A and an internal portion 12B by a flange 27A;

(ii) the duct 13 feeding water under pressure (iii) the duct 14 sucking air; and (iv) the duct 15 discharging water.

All the above components are made in one piece, i.e. moulded plastic material. The main body 12 is fixed to the wall 16 of the tub (not shown) by a locking nut 17, which engages the edge 18 of the delivery fitting be screwing.

Figure 11:
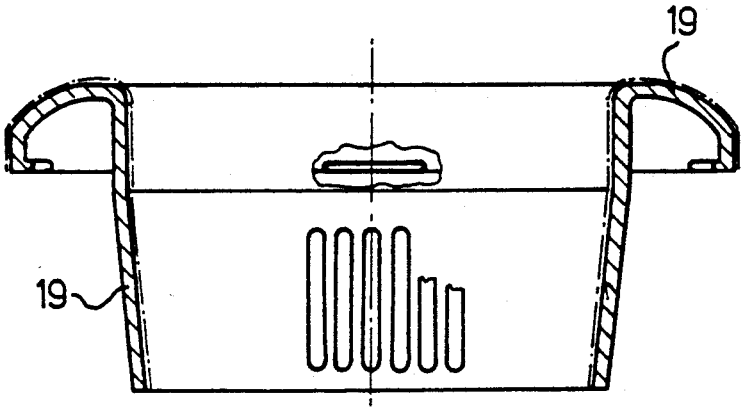
FIG. 11 is a cross-section of the locking nut covering 19 shown in FIG. 1.

The locking nut 17 can be covered by a covering 19 (shown in dotted lines in FIG. 1 and more in detail in FIG. 11), said covering being engaged with the locking nut by a click device (see FIG. 11).

The covering has a projection 19', which extends into the external portion 12A of inlet body 12 for a given length and adheres at a portion of the innermost surface of the inlet body wall.

Figures 2, 2A:
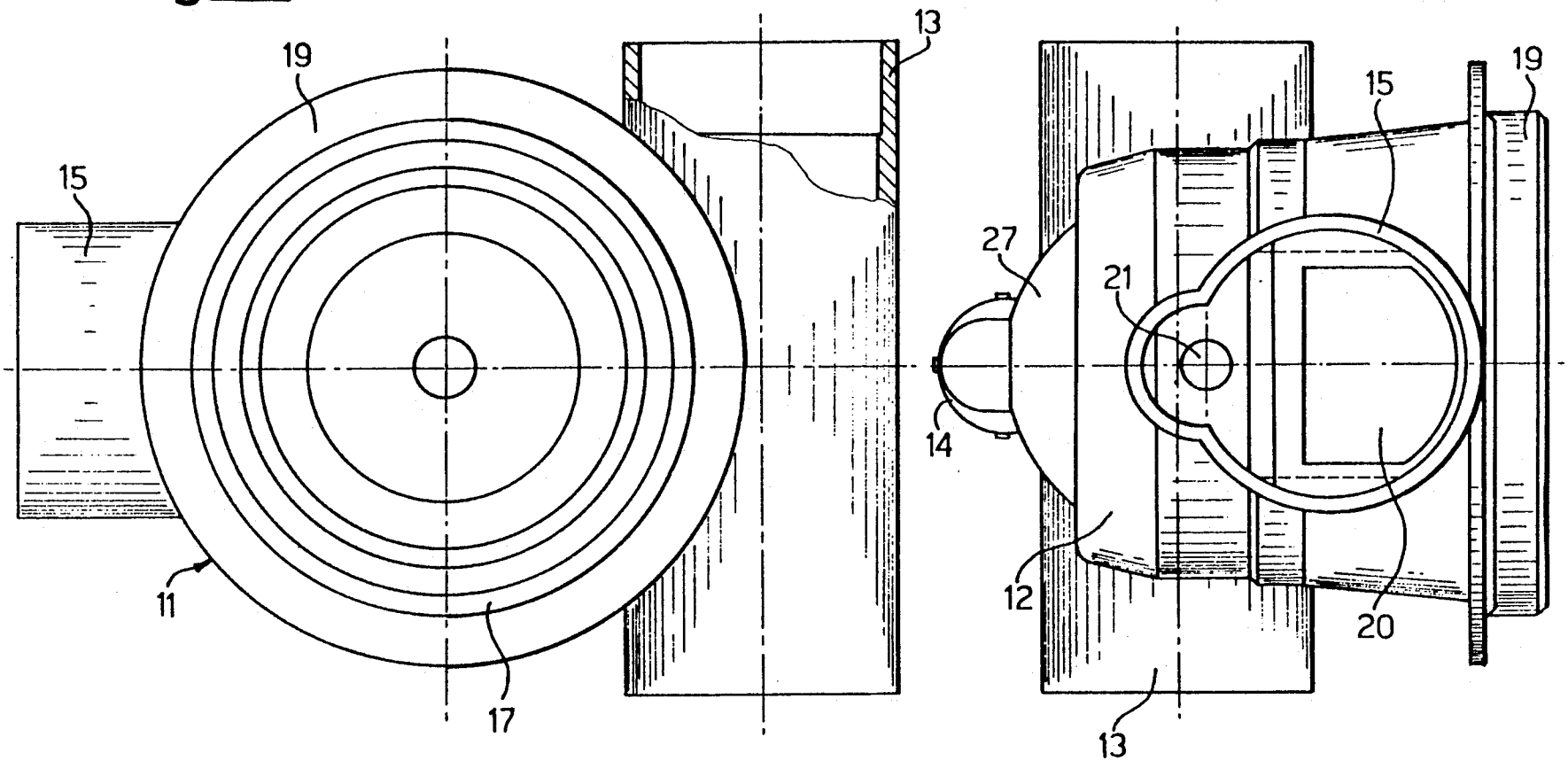
FIG. 2 is a frontal view of the delivery fitting of FIG. 1.
FIG. 2A is a plan view of the delivery fitting of FIG. 1.

The FIGS. 2 and 2A show the covering 19, the feeding water duct 13, the discharging water duct 15 in different views for a better understanding.

Figure 3:
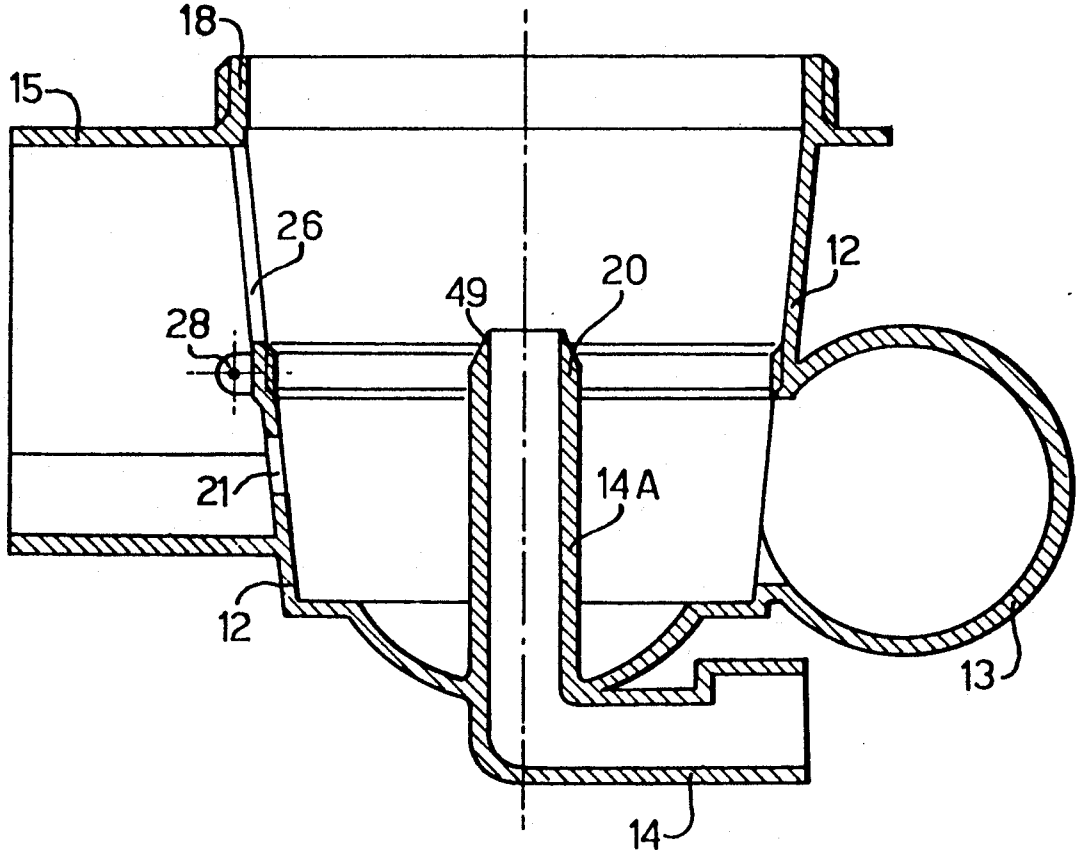
FIG. 3 is a cross-section of the inlet body of FIG. 1.

The FIG. 3 shows the air duct 14, the end of which forms a nozzle 20 positioned downstream of the openings for water coming from the duct 13.

At the internal portion 12B of the body 12 there is one opening 21 with a valve 22 (FIG. 1) having a flat cap an a rod 23 with check teeth and a spring 25 to hold open the aperture 21.

At the external portion 12A of the body 12 (near the opening 21) there is a larger aperture 26, as a passage for the discharging water duct 15; a lug 28 with a hole is positioned under the aperture 26, inside the duct 15.

The internal portion 12B of the body 12 has a shape of a spheric cap 27, the axis of which coincides with the axis of last or terminal portion 14A of the duct 114 ending with the nozzle 20.

Figure 3A:
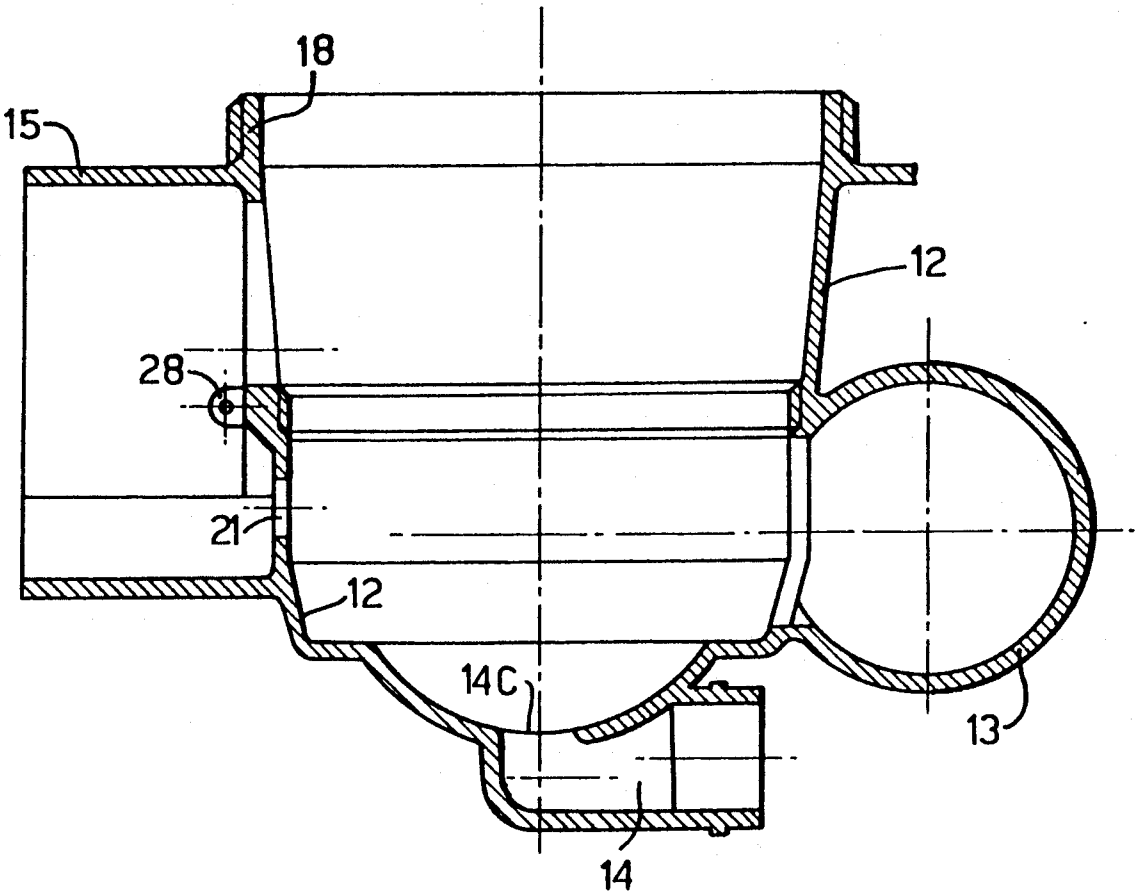
FIG. 3A is a cross-section of the inlet body, according to another embodiment.
Figure 6:
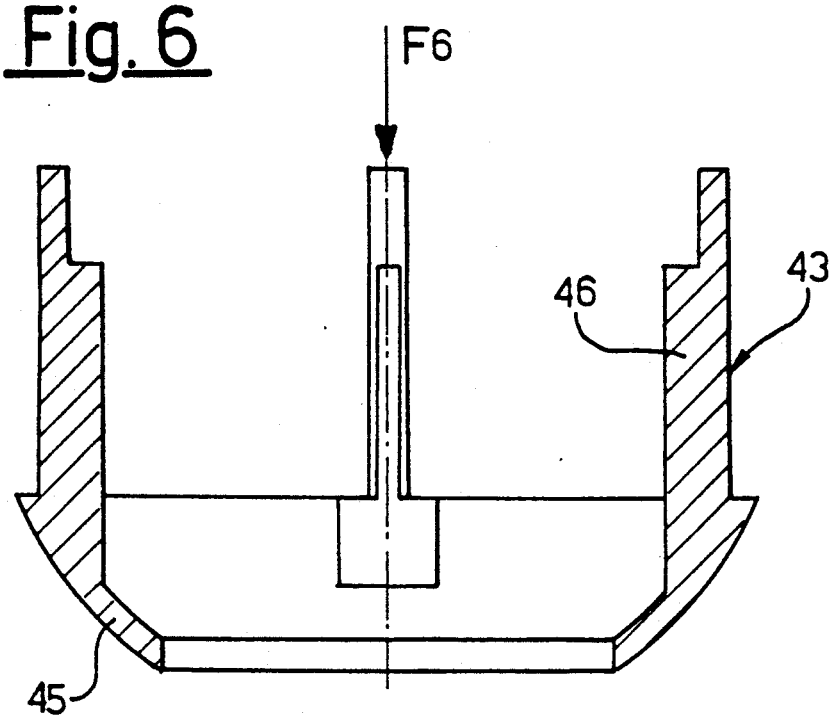
FIG. 6 is a cross-section of a third part housed in the inlet body of FIG. 3.
Figure 6A:
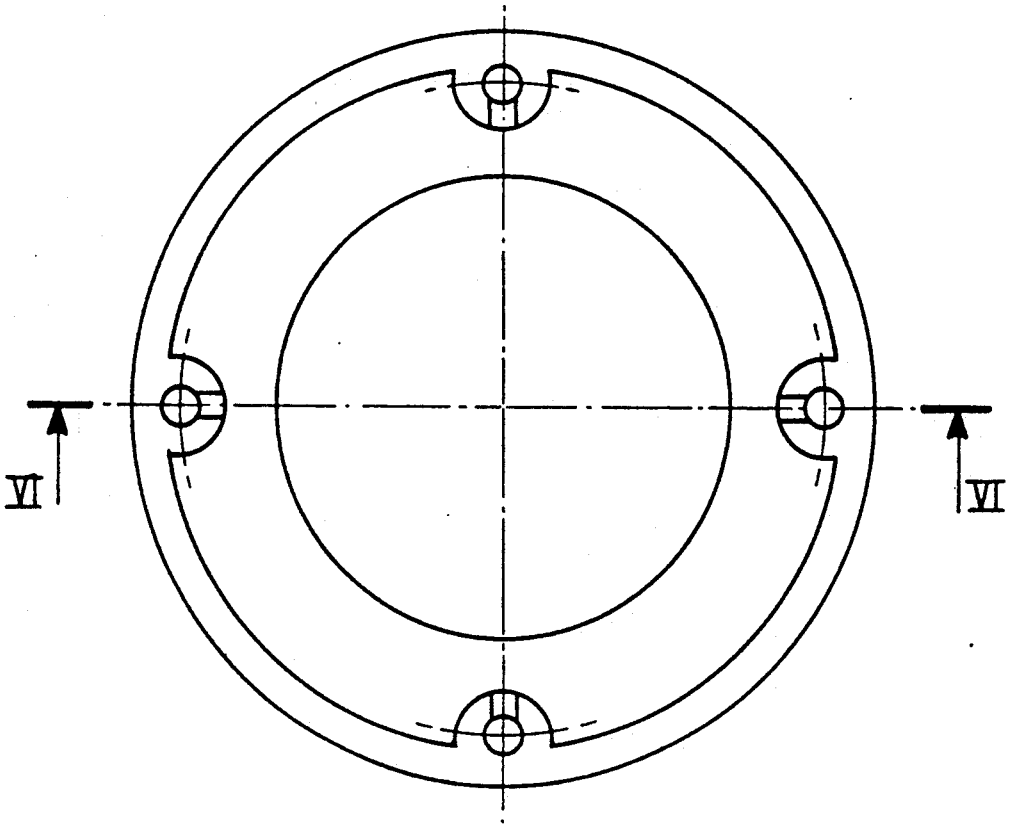
FIG. 6A is a frontal view of the part shown in FIG. 6.
Figure 6B:
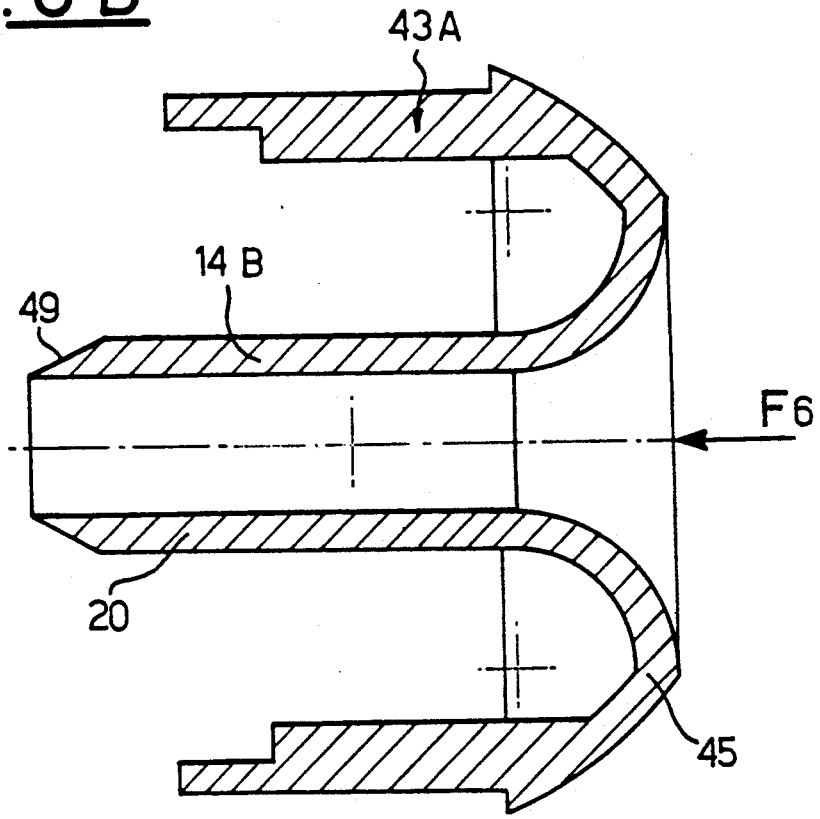
FIG. 6B is a different embodiment of FIG. 6.
Figure 7:
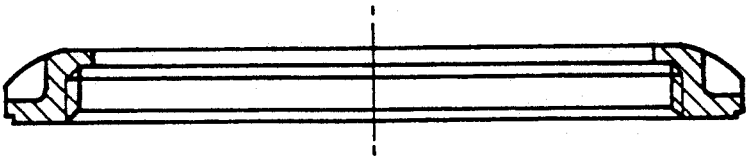
FIG. 7 is a cross-section of the locking nut 17 shown in FIG. 1.

In the modified embodiment of the inlet body 12 shown in FIG. 3A the last or terminal part 14A of the air duct 14, and the nozzle 20 are lacking or omitted; and the air duct 14 is directly connected with the spheric cap at the bottom 14C of the body; the last part 14A and the nozzle 20 are made in a one-piece component shown in FIG. 6B.

Figure 4A:
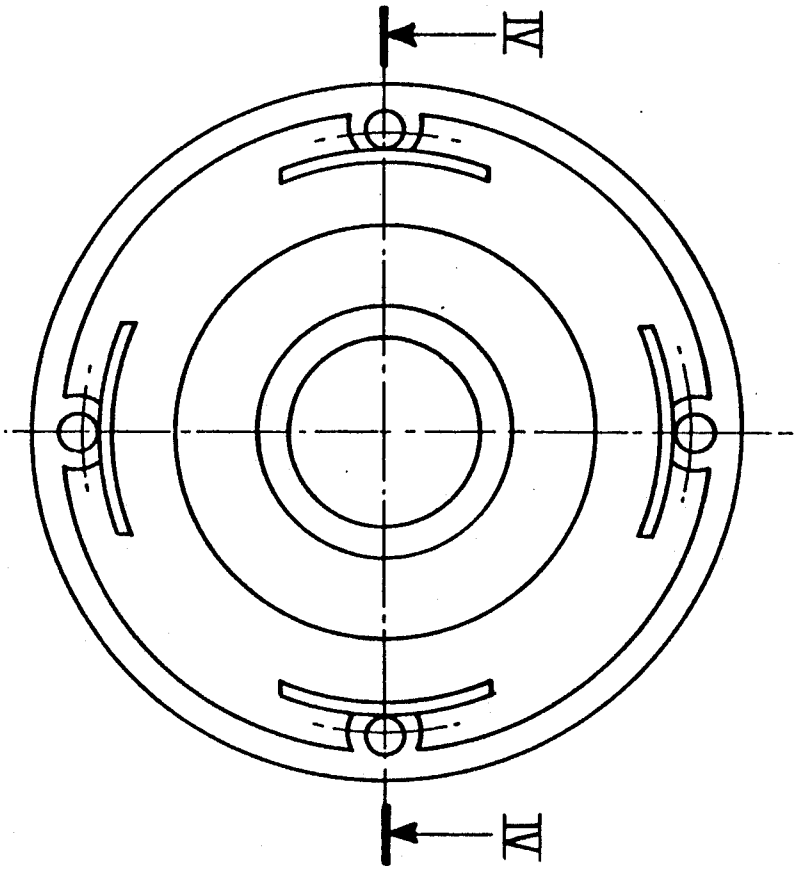
FIG. 4A is a frontal view of the part shown in FIG. 4.
Figure 4:
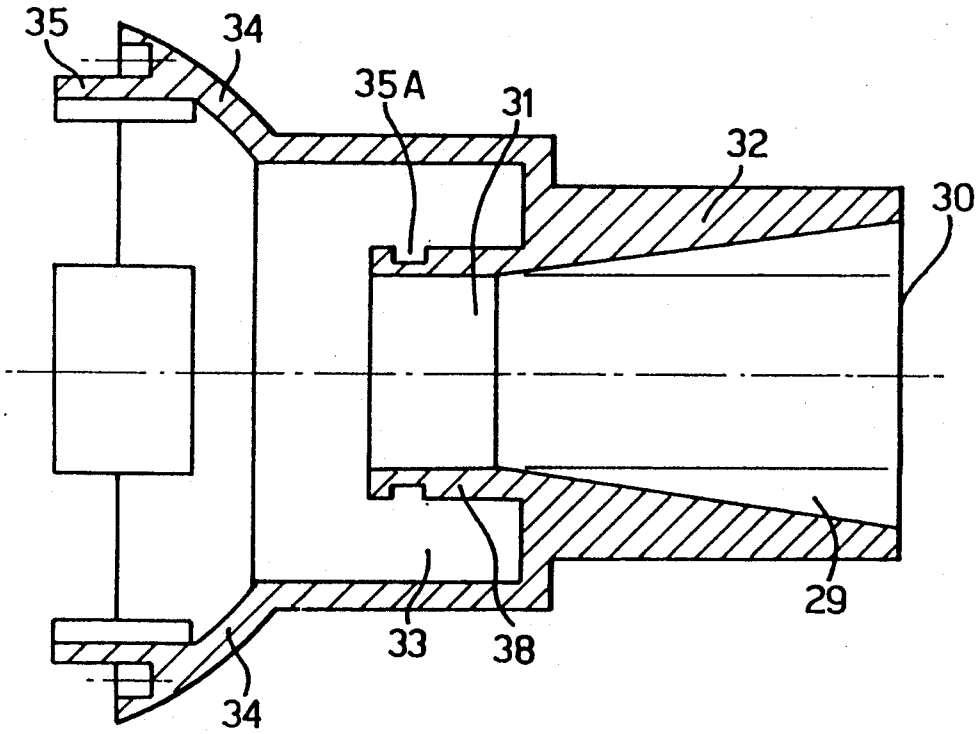
FIG. 4 is a cross-section of a first part housed in the inlet body of FIG. 3.

At shown in the FIG. 1, inside of the internal portion 12B of the main body 12 is mounted the delivering device for ejecting the water, coming from the duct 13, mixed with air, coming from the duct 14 and nozzle 20; said delivering device being coaxial with the body 12 and having a member of components (32, 36, 43) shown in detail in the FIGS. 4, 4A, 5, 5A, 6, 6A and 10 and held in the internal portion 12B by the flange 27A. FIG. 4 shows the cross-section of the outermost component 32 located at the highest part of the delivery fitting of FIG. 1, the opening 30 is at the level of the covering 19. The component 32 has a conduit 29 extending along the component's axis and tapering from the largest opening 30 towards the smallest opening 31; the opening 31 has a cylindrical shape.

Around the cylindrical opening 31 there is an annular recess 33, described in more detail hereinafter.

The component 32 shows a portion 34 having a shape of a spheric cap, water-tight with the walls of a complementary opening (see FIG. 1); the contacting surfaces can slide one to the other for an angular displacement of the component 32.

The component 32 has a projection 35 for assembling the component 32 with the component 43 (see FIG. 10) and an annular groove 35A housing a water sealing element (not shown).

Figure 5:
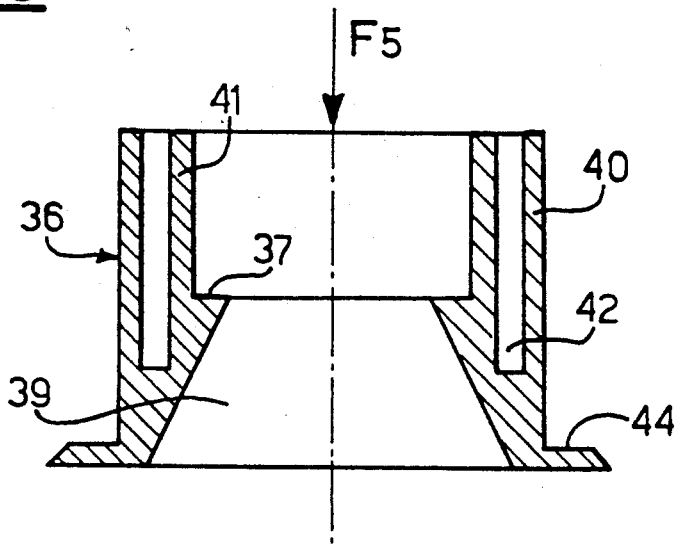
FIG. 5 is a cross-section of a second part housed in the inlet body of FIG. 3.
Figure 5A:
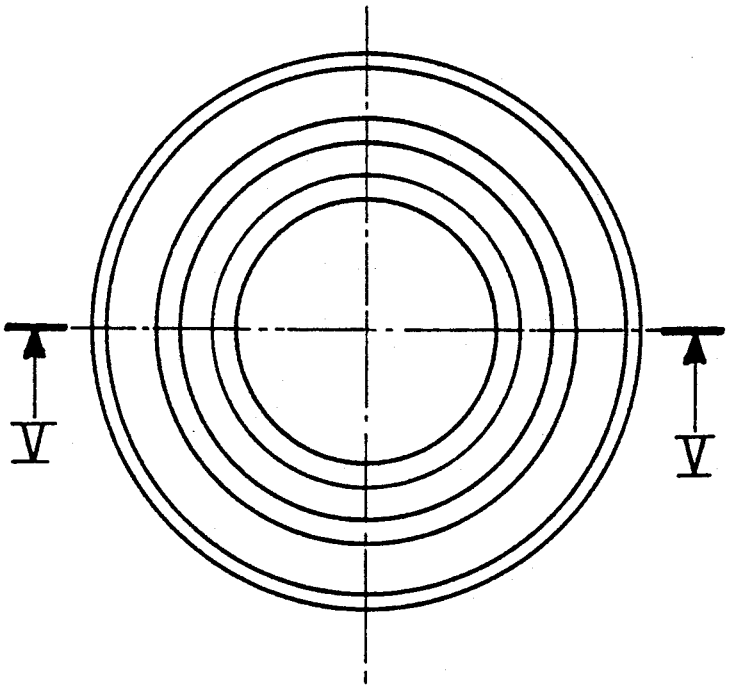
FIG. 5A is a frontal view of the part shown in FIG. 5.

The FIG. 5 shows the cross-section of the intermediate component 36 (see also FIG. 10); the component 36 has a seat 37 housing the projection 38 of the component 32 (FIG. 4), a conduit 39 tapering from said seat 37 to the bottom of the component 36; the opening of the conduit 39 at the bottom is larger than that at the level of the scat 37, so that the coaxial conduits 39, 31, 29 form an opening having a Venturi configuration. Inside the conduit 39 is located the nozzle 20 of the duct 14, so that the depression in front of the nozzle, caused by the water flow through the Venturi conduit, induces an air suction from the nozzle 20.

Figure 10:
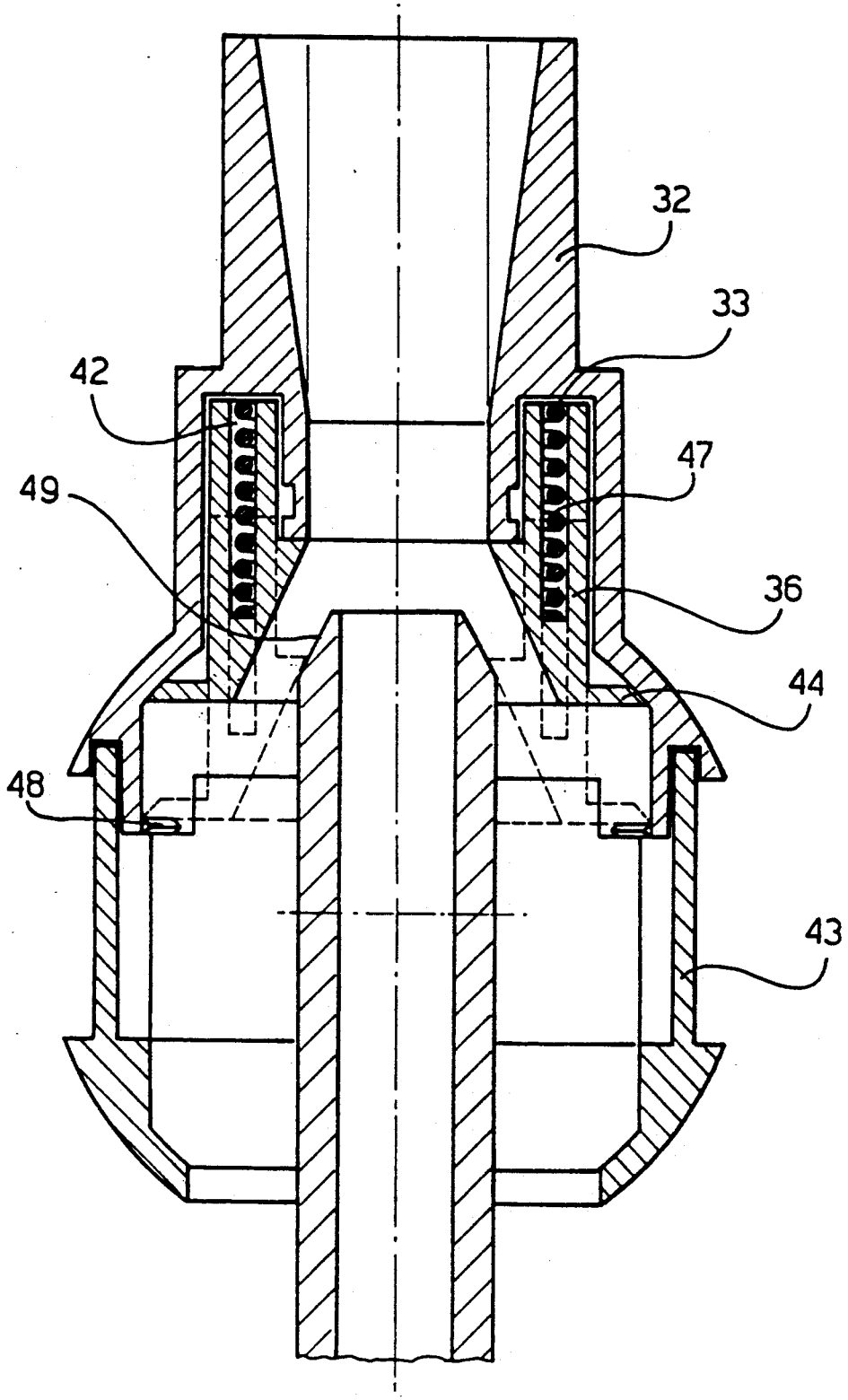
FIG. 10 is a cross-section of the assembling of the parts shown in FIGS. 4, 5 and 6

The component 36 has two cylindrical projections 40, 41 with an annular opening 42 therebetween; the projections 40, 41 are housed in the annular recess 33 of the component 32 (FIG. 10).

The bottom of the component 36 has an annular, tapered projection 44, which engages the internal surface of the spheric cap 34 of the component 32 (FIG. 10); such an engagement is water-tight.

FIG. 6 shows the cross-section of the innermost component 43, which has a lowermost portion 45 having a spheric cap shape; the portion 45 engages the internal surface of the spheric cap 27; the contacting surfaces can slide one to the other for an angular displacement of the components 43, 36, 32 (FIG. 1).

The component 43 has a number of projections 46 cirumferentially spaced each from the other, so as to have a sort of cage, through the spaces between the projections 46, and the water coming from the duct 13 is introduced into the delivery device to be ejected with the air coming through the nozzle 20 from the opening 30 into the bath tub.

FIG. 10 shows the cross-section of the assembling of the three components 43, 36, 32.

A spring 47 is housed in the annular opening 42 (FIG. 5), and it reacts between the base of the annular opening 42 and the top of the annular recess 33, moving the component 36 axially away from the component 32; the tapered projection 44 slides along the internal surface of the spheric cap 34 of the component 32 to reach the stop 48 of the component 43.

In this position the internal wall of the conduit 39 rests on the tapered end 49 of the nozzle 20 and it closes the water flow to the conduits 31 and 29, as shown by dotted lines in FIG. 10; the full lines show the device in operation, in which the spring 47 is compressed by the water pressure, the component 32 is moved away from the nozzle 20 and a water passage is open therebetween.

In such a condition the water pressure is in equilibrium with the spring thrust. In the embodiment shown in FIG. 6B the component 43A is identical to the component 43 or FIG. 6, as far as the parts 45 and 46 are concerned; it presents the conduit 14B and the nozzle 20 corresponding to the conduit 14A of FIG. 3; when the component 43A is assembled inside the inlet body 12 of FIG. 3A, the conduit 14B is axially aligned with the opening 14C at the bottom of the body and connected with the duct 14.

Figure 8:
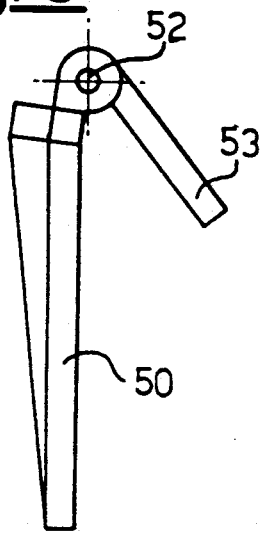
FIG. 8 is a lateral view of the valve 50 shown in FIG. 1.
Figure 9:
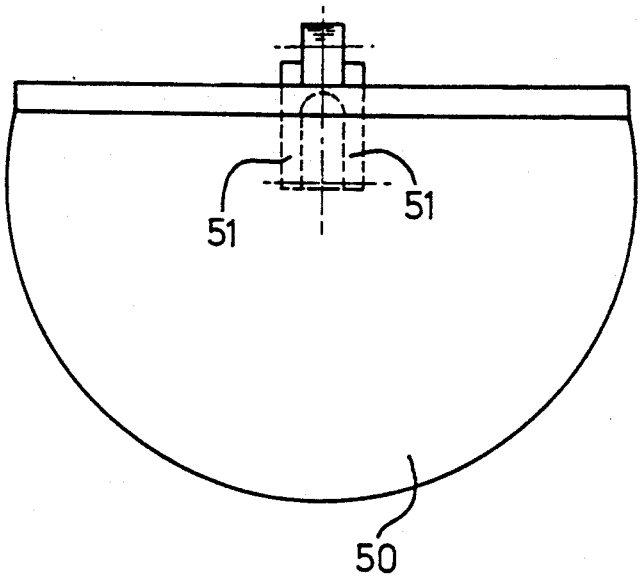
FIG. 9 is a plan view of the valve of FIG. 8.

As hinted above, the delivery fitting according to the present invention has a water discharge passage ad means to avoid backwater in the body of the delivery fitting. As shown in FIG. 3, the aperture 26 is controlled by a valve having a plate 50 (FIGS. 8, 9) with a U-shaped bracket 51; a pin 52 is coupled, with the lug 28 of the body 12; and an arm 53 is rigidly connected to the plate 50.

The plate 50 rotates around the pin 52 to open (see dotted lines in FIG. 1) and close (see full lines in FIG. 1) the aperture 26; the angular rotation is controlled by an electromagnet 54 having a keeper 55 for the arm 53.

In the discharging water duct 15 a ferrule 56 is provided to adapt such a duct to the domestic hydraulic system, the duct 15 (or ferrule 56) is connected with all delivery fittings of the pump of the installation, including the delivery fittings to the suction side of the circulating pump.

To avoid backwater in the body of the delivery fitting, there is the opening 21 with a valve 22 (FIG. 1), which is connected with the duct 15. Valve 22 discharges into duct 15.

The operations of the delivery fitting, according to this invention, is herein after described.

DESCRIPTION OF OPERATION OF THE INVENTION

When the pump of the equipment is actioned, the water under pressure enters the delivery fitting body 12 coming from the duct 13, and through the spaces between and among the projections 46 of the component 43 enters the cavity of said component, the water thrusting the bottom portion of the internal walls of the conduit or duct 39 of the component 36 (see FIGS. 5 and 10). The component 36 is moved away from the tapered end 49 of the nozzle 20, the spring 47 is compressed and a water passage is opened therebetween; the water flows into the conduits or ducts 31 and 20.

In the conduit or duct 31 the water flow causes a depression, inducing an air suction from the nozzle 20 and the duct 14, and the water mixed air is ejected under controlled pressure from the opening 30 into the bath tub of the hydromassage installation or equipment.

At a proper time, when the water level in the bath tub is high enough to enter the main body 12 of the delivery fitting, the electromagnet 54 is actuated so that the valve 50 is opened, and if the level of the water in the bath tub is high enough, the water overflows through the passage or aperture 26, into the discharging duct is to be addressed or recirculated to the pump.

When the hydromassage is over, the pump is stopped, the electromagnet is actuated to open the passage or aperture 26 and discharge the remaining water from the delivery fitting. In the meantime, since the internal portion 12B of the delivery of water pressure inside the body 12 has fallen down or decreases, the valve 22 is opened by the spring 25, so that even the water contained in the bottom portion of the delivery fitting flows into the conduit or duct 15.

Figure 1A:
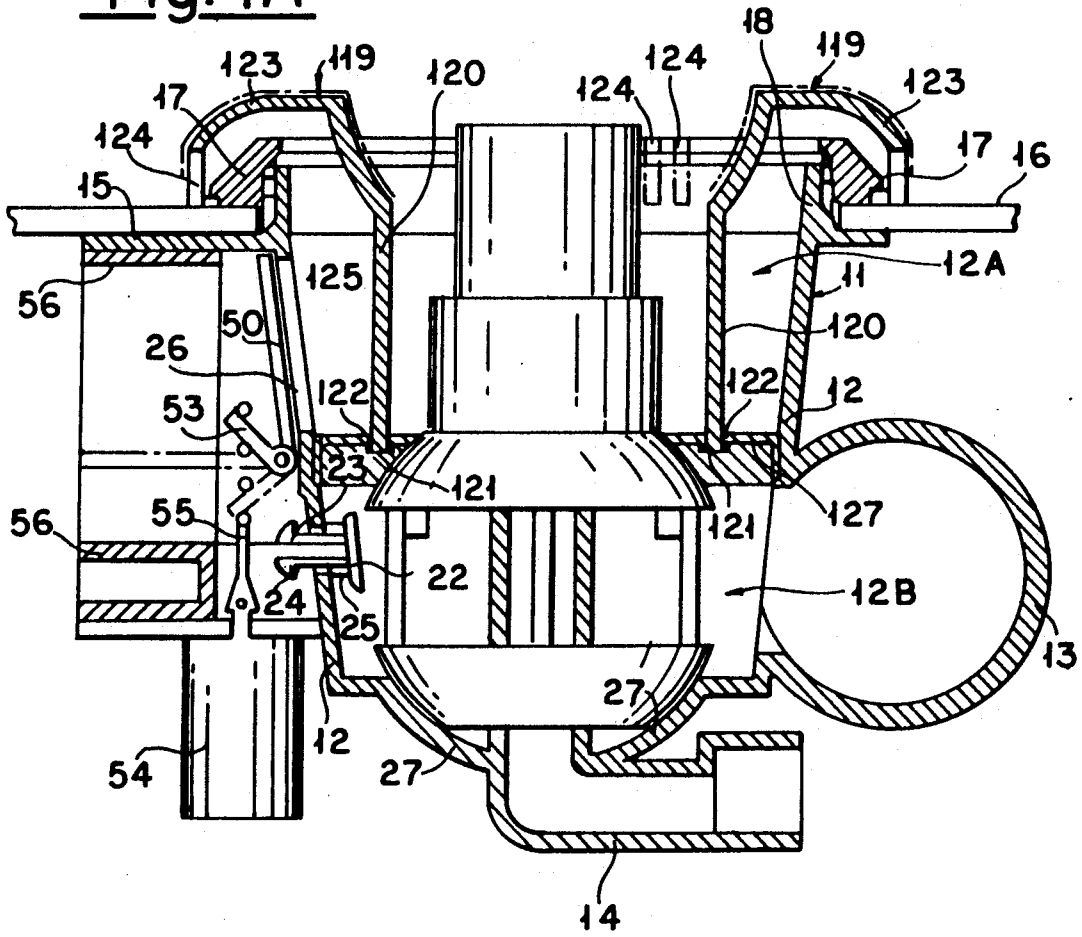
FIG. 1A is a lateral view, partially in cross-section, of a different embodiment of the delivery fitting, according to the present invention.

A further preferred embodiment of the delivery fitting according to this invention, is shown in FIG. 1A in which the same numerical references of FIG. 1 are maintained whenever possible.

A covering 119 has a projection 120 extending inside the cavity of the main body 12 of the delivery fitting 11, to completely cover the discharge opening 26 connected with the duct 15 under the control of the valve 50.

The innermost edge 121 of the projection 120 is housed in an annular groove 122 on the flange 127, so that no air accidentally coming from the main body cavity is allowed to reach the conduit 15 and then the pump of the equipment.

With such an arrangement any suction of air by the pump is avoided with the advantage to have no irregular jets due to pump cavitations.

The outermost portion of the covering 119 has a cap 123 over the locking nut 17, the annular edge of the cap is engaged in an annular groove of the locking nut 17.

The cap 123 has the lateral openings 124 communicating with the main body cavity 125 constituted by the projection 120, the flange 127 and the opening 26; through the openings 124, the cavity 125, the opening 50 and the duct 15 the water passes from the bath tub to the pump for the hydromassage cycle.

With the lateral openings 124 the suction of the water from the bath tub to the pump is assured, even if the opening of the delivery fitting were accidentally obstructed, for example by the user's body.

From the above description, further advantages of the delivery fitting, will be apparent, according to the present invention.

Firstly, the opening and closing of the delivery fitting is controlled by the pump of the installation; if the hydraulic pressure falls down, the air conduits are tightly separated from the water conduits.

Secondly, the delivery fittings, according to this invention, can be used for discharging and/or recycling the water, so that the normal discharge fitting in the bath tub can be avoided.

Thirdly, any backwater in the body of the delivery fitting is eliminated with evident advantages in terms of hygienics and life of the components.

I claim:

1. A delivery fitting for a hydromassage bath tub comprising:

an inlet body (12) adapted to be fixed in a tub wall (16) and divided into a first chamber (12A) being open to communicate with an interior of the tub, and a second chamber (12B) by a flange (27A), said second chamber (12B) being connected with a first duct (13) for feeding water under pressure from a pressure side of a water source, and a second duct (14) for sucking air, an axial delivery duct (29,30,31) to deliver water mixed with air to the tub, said delivery duct having an inlet end disposed in said second chamber and an outlet end disposed in said first chamber and being in sealing engagement with said flange intermediate said inlet and outlet ends, said delivery duct further having a cross-section at each end (30,39) larger than that at an intermediate portion (31) to have a Venturi effect, said second duct having an outlet end provided with a nozzle (20) coaxially aligned within said delivery duct (29), said nozzle being disposed proximate to said intermediate portion (31); and said first chamber (12A) of said inlet body (12) having a first aperture (26) in a sidewall thereof to discharge water to a circulation duct (15) connected to an inlet side of the pressurized water source, the discharge of water through said first aperture being controlled by a first valve (50).

2. A delivery fitting according to claim 1, wherein said first chamber (12A) sidewall tapers towards the second chamber, said aperture (26) being positioned on the tapered wall.

3. A delivery fitting according to claim 2, wherein said second chamber (12B) of said inlet body (12) has a second aperture (21) positioned on second chamber of said body (12) adjacent said first aperture (26), said second aperture (21) being controlled by a second valve (22) responsive to the water pressure supplied through said first duct (13), said second valve being movable to a first closed by the water pressure position and a second open position by spring means (25), the second aperture communicating with the circulation duct (15).

4. A delivery fitting according to claim 1, wherein said first valve (50) has a plate movable between a first open position and a second closed position with respect to said first aperture (26), the movement of said plate being controlled by activating means.

5. A delivery fitting according to claim 4, wherein said activating means includes an electromagnet (54).

6. A delivery fitting according to claim 1, wherein said second chamber (12B) of said inlet body (12) has a second aperture (21) positioned on the sidewall of said body (12) adjacent said first aperture (26), said second aperture (21) being controlled by a second valve (22) responsive to the water pressure supplied through said first duct (13), said second valve being movable to a first closed position by the water pressure and a second open position by spring means (25).

7. A delivery fitting according to claim 1, wherein said axial delivery duct comprises a first component (32) having a first axial duct (29) which tapers towards the second chamber and a second axial cylindrical duct (31), a second intermediate component (36) having a third axial duct (39) which tapers towards the first component and contacts a tapered end of said nozzle (20), the intermediate component (36) being axially movable with respect to the nozzle end, and a third component (43) having an outer spherically shaped portion (45) and circumferentially spaced projetions (46).

8. A delivery fitting according to claim 7, wherein said nozzle (20) is an integral one-piece member with said third component (43).

9. A delivery fitting according to claim 1, wherein a cover (119) engages a locking nut (17) that secures said inlet body to the tub wall, said cover having a cylindrical skirt (120) which extends into said first chamber (12A) of the inlet body (12) and sealingly engages said flange to form a third annular chamber (125) within said first chamber and in communication with said first aperture, said cover further having a cap (123) with lateral openings (124) communicating with said third chamber (125) and the interior of the tub.

10. A delivery fitting according to claim 9, wherein the skirt (120) terminates in an edge (121) received in an annular groove (122) formed in the flange (127) located in said inlet body.

11. A delivery fitting for a hydromassage bath tub comprising:

an inlet body (12) adapted to be fixed in a tub wall and connected with a first duct (13) for feeding water under pressure from a pressure side of a water source and a second duct (14) for sucking air; and an axial delivery conduit (29,30,39) for delivering water mixed with air to the tub, said delivery conduit having an inlet en sealingly connected with said first duct and an outlet end adapted to deliver water mixed with air to the tub, said delivery duct further having a cross-section at each end (30,39) larger than that at an intermediate portion (31) to have a Venturi effect;

said second duct having an outlet end provided with a nozzle (20) coaxially aligned within said delivery duct (29), said nozzle being disposed proximate to said intermediate portion (31);

said inlet body (12) having a first aperture (26) in a sidewall thereof for discharging water to a circulation duct (15) connected to an inlet side of the pressurized water source, the discharge of water through said first aperture being controlled by a first valve (50);

said first valve (50) having means for moving it between a first open position and a second closed position, said moving means being controlled by activating means.

12. A delivery fitting according to claim 11, wherein said inlet body (12) sidewall is tapered towards the exterior of the tub and said aperture (26) being positioned on said tapered wall.

13. A delivery fitting according to claim 11, wherein said first valve includes a movable plate.

14. A delivery fitting according to claim 11, wherein said activating means includes an electromagnet.

15. A delivery fitting according to claim 11, wherein said inlet body (12) includes a flange sealingly engaged between the sidewall thereof and said delivery conduit below said first aperture forming a first chamber for communication with the interior of the tub and a second chamber, said delivery conduit inlet end and said first duct being in communication with said second chamber, said second chamber having a second aperture (21) positioned on the sidewall of said body adjacent said first aperture (26) such that said second aperture communicates with said circulation duct, said second aperture being controlled by a second valve (22) responsive to the water pressure supplied through said first duct (13), said second valve (22) being movable to a first closed position by the water pressure and a second open position by spring means.

16. A delivery fitting according to claim 11, wherein said axial delivery conduit comprises a first component (32) having a first axial conduit (29) tapering towards the exterior of the tub and a second axial cylindrical conduit (31), a second intermediate component (36) having a third axial conduit (39) tapering towards the first component and contacting a tapered end (49) of said nozzle (20), the intermediate component (36) being axially shift able with respect to said nozzle end, and a third component (43) having an outer portion (45) of spheric cap shape and circumferentially spaced projections (46).

17. A delivery fitting according to claim 16, wherein said nozzle (20) is a one-piece unit with said third component (43).

18. A delivery fitting according to claim 11, including a cover (119) engaging a locking nut (17) that secures said inlet body to the tub wall, said cover having a cylindrical skirt (120) extending into said inlet body (12) and sealingly engaged between said inlet body sidewall and said delivery conduit below said first aperture forming an annular chamber (125) between said skirt and said inlet body sidewall, said cover further having a cap (!23) provided with lateral openings (124) communicating with said annular chamber (125) and the interior of the tub.

19. A delivery fitting according to claim 18, wherein said skirt (120) terminates in an edge (121) received in an annular groove (122) formed in a flange (127) sealingly engaged between said inlet body sidewall and said delivery conduit below said first aperture.

* * * * *